United States Patent [19]

Kopis

[11] 4,092,951

[45] June 6, 1978

[54] MENISCUS FORMING APPLICATOR INCLUDING VACUUM ANTI DRIP

[76] Inventor: Floyd B. Kopis, 330 Interstate Rd., Addison, Ill. 60101

[21] Appl. No.: 794,811

[22] Filed: May 9, 1977

Related U.S. Application Data

[62] Division of Ser. No. 506,355, Sep. 16, 1974, abandoned.

[51] Int. Cl.[2] ..... B05C 5/00; B05C 7/06

[52] U.S. Cl. ..... 118/50; 118/254; 118/256

[58] Field of Search ..... 118/50, 50.1, 214, 215, 118/401, 408, 405, 421, DIG. 10, DIG. 2; 427/238, 445, 235, 294–298, 350; 134/166 C, 167 C, 168 C, 169 C; 401/9, 10

[56] References Cited

U.S. PATENT DOCUMENTS

| | | | |
|---|---|---|---|
| 1,147,374 | 7/1915 | Coe | 401/9 |
| 1,182,982 | 5/1916 | Crump | 118/421 |
| 2,257,936 | 10/1941 | Bowers et al. | 118/DIG. 10 |
| 2,694,211 | 11/1954 | Warren | 401/9 X |
| 2,832,694 | 4/1958 | Vodicka | 427/350 X |
| 3,404,025 | 10/1968 | Wooton | 118/401 X |
| 3,413,143 | 11/1968 | Cameron et al. | 118/410 X |
| 3,524,757 | 8/1970 | Havens | 118/408 X |
| 3,827,397 | 8/1974 | Hebberling et al. | 118/50 |
| 3,900,866 | 8/1975 | Bell et al. | 118/50 X |

FOREIGN PATENT DOCUMENTS

| | | | |
|---|---|---|---|
| 1,201,935 | 8/1970 | United Kingdom | 118/401 |

*Primary Examiner*—Morris Kaplan

*Attorney, Agent, or Firm*—Burmeister, York, Palmatier, Hamby & Jones

[57] ABSTRACT

An apparatus is provided for applying liquid to solid surfaces to which access may be limited or restricted. Liquid is continuously fed to an applicator where the liquid clings to a supporting surface to form a bead defining an outwardly exposed meniscus protruding beyond the applicator. The applicator is moved along the surface in a proximate relationship thereto which brings the protruding meniscus into contact with the surface to wipe liquid onto the surface, the applicator all the while being spaced a slight but noncritical distance from the surface. A portion of the liquid wiped onto the surface is immediately aspirated from the surface by suction applied through the applicator to leave on the surface a deposit of liquid controlled in quantity by the degree of aspiration accompanying the wiping of liquid onto the surface. The continuous aspiration of liquid from the liquid bead forming the protruding meniscus on the applicator prevents dripping of liquid from the applicator and functions in conjunction with continuous feeding of liquid to the meniscus to provide a continuous circulation of liquid on the applicator, even when it is awaiting usage, with no fouling of the applicator and no stagnation or deterioration of the liquid on the applicator.

5 Claims, 6 Drawing Figures

Fig. 4.
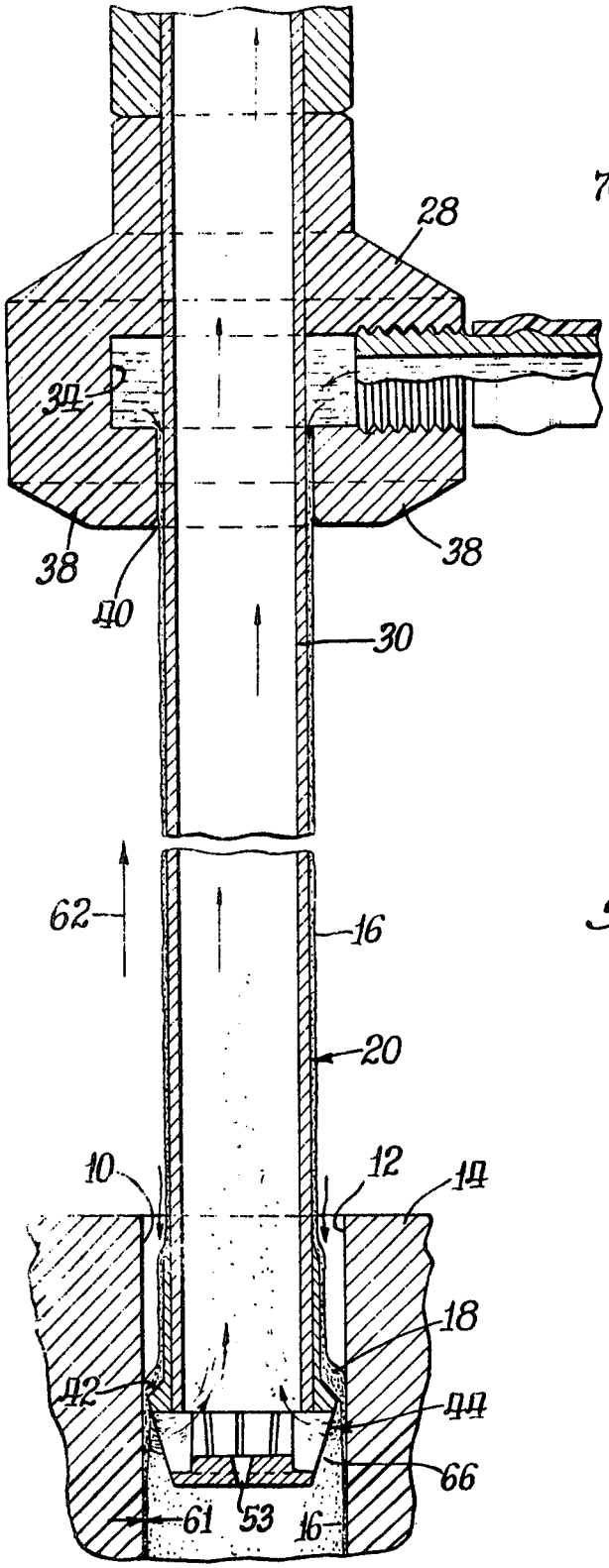
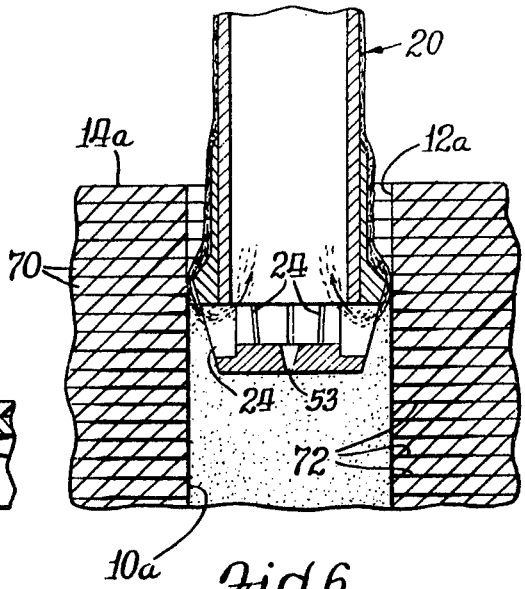
Fig. 6.
Fig. 5.
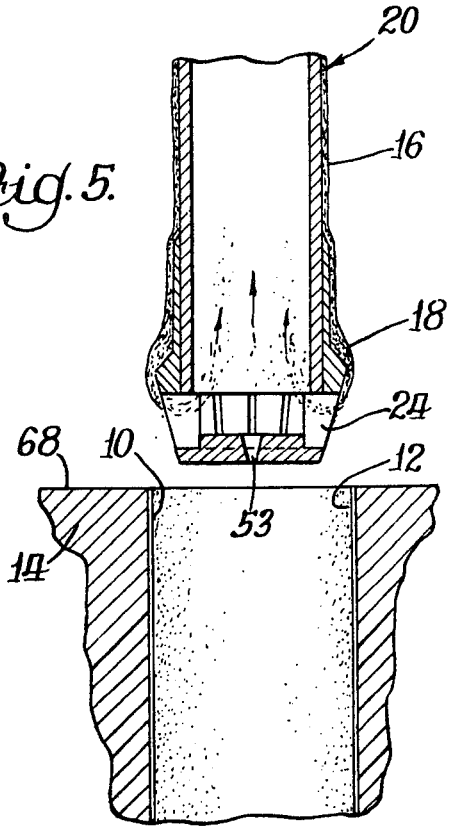

MENISCUS FORMING APPLICATOR INCLUDING VACUUM ANTI DRIP

This application is a division of the applicant's copending application, Ser. No. 506,355, filed Sept. 16, 1974, now abandoned.

This invention relates to the application of a liquid to the surface of an object and is concerned particularly with the application of a liquid to surfaces to which access is restricted; for example, to the inside surfaces of bores or to the internal surfaces within objects or structures where access is limited.

One object of the invention is to provide a new and improved apparatus for applying liquid to the surface of an object or structure, which is particularly well suited for applying liquid to surfaces to which access is limited or restricted.

A further object is to provide for applying a liquid to a solid surface, a new and improved apparatus which achieves a highly uniform distribution of the liquid over the surface and at the same time controls in a highly efficient manner the quantity of liquid deposited on the surface.

Another object is to provide for spreading a liquid over the surface of a solid object, a new and improved apparatus, as recited, which provides an accurate control of the quantity of liquid spread on the surface and achieves an even distribution of the liquid over the surface, all without any necessity for measuring the quantity of liquid deposited on the surface.

Another object is to provide a novel apparatus, as recited, which applies to a surface a uniform deposit of liquid as a consequence of a single pass along the surface of an applicator which does not contact the surface and which need not be precisely positioned relative to the surface, all without any requirement for measuring the quantity of liquid supplied to the applicator.

Another object is to provide an apparatus, as above, which applies liquid to a surface with high accuracy with respect to both uniformity and quantity of liquid applied to the surface, by wiping the liquid onto the surface from an applicator without touching the surface with the applicator or any necessity for maintaining a precise spacing of the applicator from the surface, a portion of the liquid wiped onto the surface being removed by aspiration to leave the desired amount of liquid deposited on the surface.

A further object is to provide an apparatus, according to the previous objects, in which a convex, outwardly exposed liquid meniscus is continuously maintained on an applicator by continuously feeding liquid to the meniscus and continuously withdrawing liquid from the meniscus, which meniscus is moved along a solid surface in interferring relation thereto to deposit liquid on the surface, the liquid on the applicator including that from the meniscus being virtually immune to hardening or other deterioration in the atmosphere, even when the applicator is not being used, by virtue of the continuous circulation of the liquid forming the meniscus.

Still another object is to provide an apparatus, as recited, wherein a liquid is continuously fed to an applicator to form an outwardly exposed convex meniscus from the lower side of which liquid is continuously aspirated so that there is never any dripping of liquid from the applicator and the liquid thereon is in continuous circulation so as to avoid deterioration from stagnation and the applicator is effective for applying liquid to a surface by movement of the applicator along the surface with the liquid meniscus in contact with the surface.

An additional object is to provide an apparatus as recited, which is particularly well suited for applying liquid to the inner surface of a bore or other internal surface within an object.

An additional object is to provide an apparatus, as recited, which will operate effectively to apply liquid to a surface along a path having an indeterminate or variable length, automatically maintaining the desired uniformity of application of the liquid to the surface without adjustment or other compensation to take into account the length of the path along which the deposit is made.

A more specific object is to provide an apparatus, as recited, which will deposit liquid on a surface along a path without leaving an excessive deposit at either end of the path, even though the path may terminate at a corner of the object defining the surface.

Another specific object is to provide an apparatus, as described, which will function with great efficiency to apply to a surface liquids of widely varying viscosity.

For applying liquid to the surface of an object, the present invention may comprise an applicator defining thereon an outwardly exposed liquid support surface for supporting a liquid bead, liquid supply means connected with said applicator for continuously feeding liquid onto said support surface on the applicator to adhere to said liquid support surface and swell outwardly under the restraint of surface tension to form a protruding liquid bead defining a convex meniscus, said applicator defining an aspirating intake immediately underlying said liquid bead supporting surface on the applicator, suction means connected with said aspirating intake on the applicator to continuously aspirate through said intake liquid descending from said bead support surface on the applicator, and means connected with the applicator for traversing the applicator along the surface of an object in spaced proximity thereto to contact the surface of the object with the meniscus of the liquid bead on the applicator.

In another aspect, this invention may provide an apparatus for applying liquid to solid surfaces to which access may be limited or restricted. Liquid is continuously fed to an applicator where the liquid clings to a supporting surface to form a bead defining an outwardly exposed meniscus protruding beyond the applicator. The applicator is moved along the surface in a proximate relationship thereto which brings the protruding meniscus into contact with the surface to wipe liquid onto the surface, the applicator all the while being spaced a slight but noncritical distance from the surface. A portion of the liquid wiped onto the surface is immediately aspirated from the surface by suction applied through the applicator to leave on the surface a deposit of liquid controlled in quantity by the degree of aspiration accompanying the wiping of liquid onto the surface. The continuous aspiration of liquid from the liquid bead forming the protruding meniscus on the applicator prevents dripping of liquid from the applicator and functions in conjunction with continuous feeding of liquid to the meniscus to provide a continuous circulation of liquid on the applicator, even when it is awaiting usage, with no fouling of the applicator and no stagnation or deterioration of the liquid on the applicator.

Other objects and advantages will become apparent from the following description of the invention, taken in conjunction with the accompanying drawings, in which:

FIG. 4 is a vertical sectional view showing the applicator in use to apply liquid to the inner surface of a bore;

FIG. 5 is a fragmentary longitudinal sectional view showing the relationship of the applicator just after it has moved clear of a bore coated with liquid by the applicator; and FIG. 6 is a fragmentary sectional view similar to the lower end of FIG. 4, showing the applicator in working position within a bore formed within a layered object.

Figure 1:
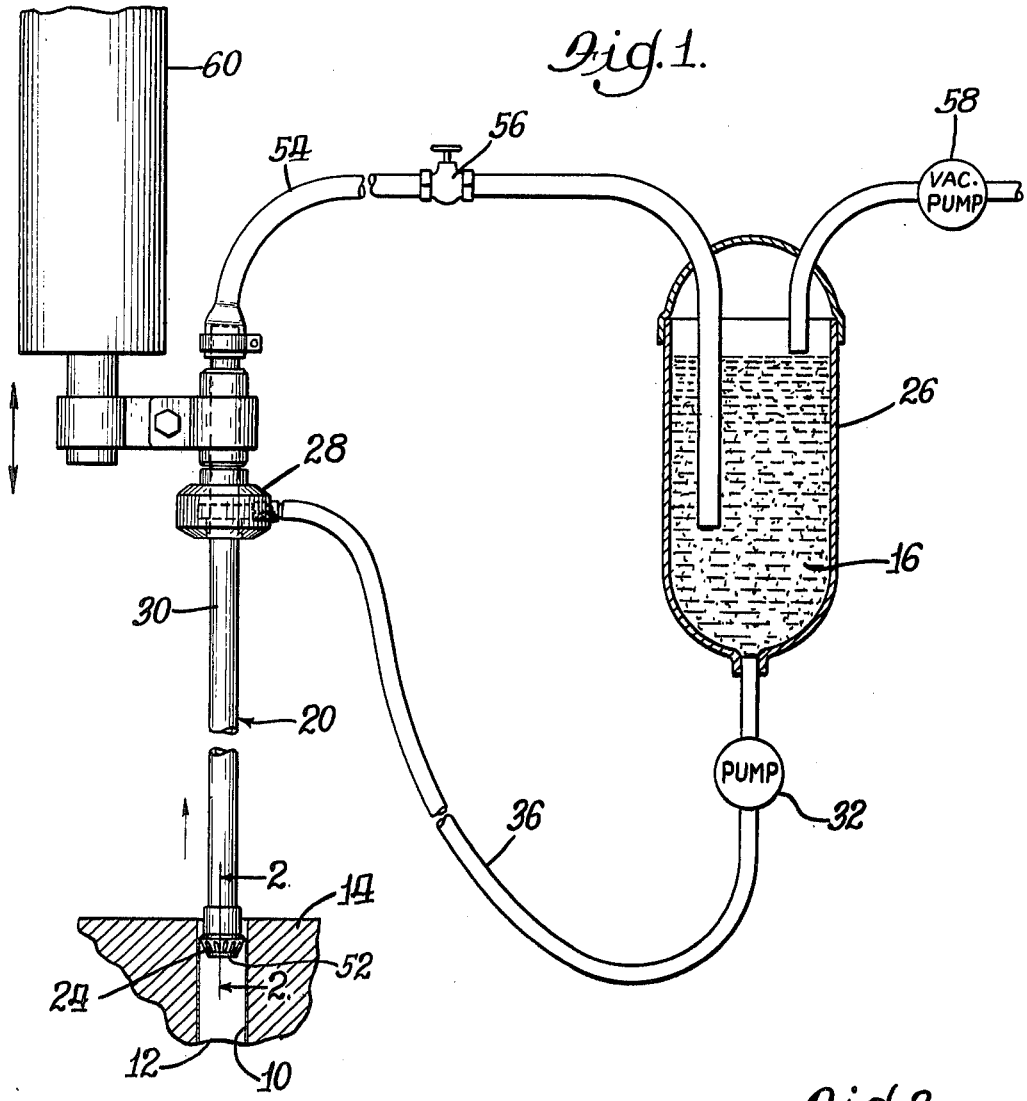
FIG. 1 is a partially sectioned elevational view illustrating the apparatus of the invention as used to apply liquid to the internal surface of a bore within an object.

Referring to the drawings in greater detail, the apparatus incorporating the invention as illustrated in FIG. 1 is designed to use the invention to apply liquid to the inner surface 10 of a bore 12 formed in an object 14.

Figure 2:
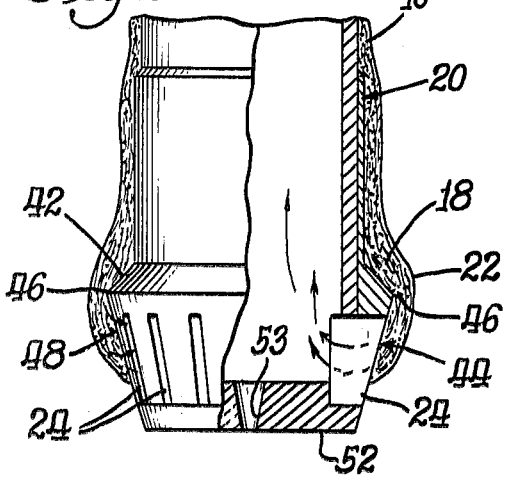
FIG. 2 is a fragmentary, partially sectioned view taken with reference to the line 2-2 of FIG. 1 and showing on an enlarged scale the applicator constructed in accordance with the invention and illustrating the dynamic condition of the applicator when it is supported clean of an object in readiness for use.
Figure 3:
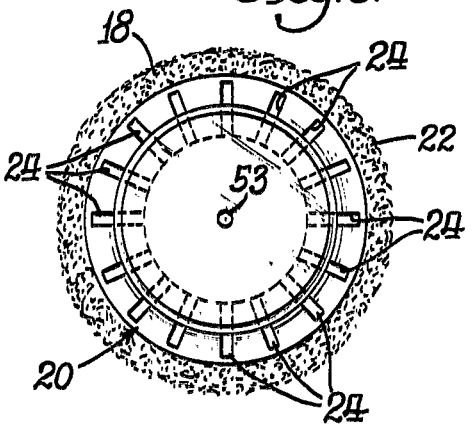
FIG. 3 is a bottom view of the applicator on an enlarged scale, looking upwardly with reference to the underside of FIG. 2.

The liquid 16, FIGS. 1 to 4, to be applied to the surface 10 is continuously circulated through a bead or repository 18 of liquid held by surface tension to an applicator 20 to define an outwardly exposed convex surface or meniscus 22 of liquid which projects somewhat beyond the structure of the applicator 20 as illustrated in FIG. 2 and as will be described further. Stagnation of liquid within the bead or repository 18 and dripping of liquid from the applicator 20, even when the applicator is not actively in use to apply liquid to the surface of an object, are prevented by keeping the liquid on the applicator, including that within the bead 18, in continuous circulation. As will be described, liquid 16 is continuously fed to the bead 18 and excess liquid is continuously aspirated from the lower side of the bead 18 by suction which is applied through the applicator 20 to aspirating orifices 24 formed in the applicator just below the liquid bead 18.

With reference to the illustrated construction, a supply of liquid 16 is contained within a closed reservoir 26, FIG. 1. From the reservoir 26 the liquid is pumped to a controlled rate, which may be adjusted, to a liquid supply collar 28 encircling, FIGS. 1 and 4, the upper portion of a generally vertical cylindrical tube 30, constituting a part of the applicator 20. In this instance, such pumping is accomplished by a pump 32 of controlled, variable output capacity connected between the bottom of the reservoir 28 and a toroidal chamber 34, FIG. 4, formed in the collar 28 in surrounding relation to the applicator tube 30. To allow the collar 28 to move with the applicator 20, the connection between the pump 32 and the collar 28 is made in this instance by a flexible conduit 36.

The lower marginal edge 38 of the collar 28 is radially spaced somewhat from the exterior cylindrical surface of the applicator tube 30 to define a circular liquid supply orifice 40 of cylindrical form opening downwardly from the toroidal chamber 34 in encircling relation to the applicator tube 30.

When in use, liquid continuously issues from the supply orifice 40 and descends downwardly along the exterior cylindrical surface of the applicator 20, which is made sufficiently long to project down into the object 14 to reach the surface to which liquid is to be applied.

The liquid 16 descending along the applicator 20 reaches a surface portion 42 of the applicator to which the liquid adheres by surface tension to form the previously mentioned bead or repository 18 of liquid that defines the outwardly exposed, convex meniscus 22.

In the construction illustrated, the lower end of the applicator tube 30, fits into the upper end of a circular foot 44 of the applicator 20. The circular external surface of the applicator foot 44 is shaped, as shown in FIG. 2, to define the previously mentioned applicator support surface 42 of the repository or bead 18 of liquid. In the preferred form shown, the liquid repository or bead supporting surface 42 swells outwardly to form a shoulder (also denoted by the number 42) having a substantial horizontal component in its shape. The particular bead support surface or shoulder 42 illustrated has the shape of a downwardly flared, truncated cone.

The lower, outer edge 46, FIG. 2, of the conically shaped liquid supporting surface 42 constitutes an overflow periphery 46 of the surface 42. Liquid adheres to the supporting surface 42 and swells outwardly under the elastic restraint of surface tension to overhang the overflow periphery 46 and form the bead or repository 18 of liquid that defines the convex meniscus 22.

The mass of liquid constituting the bead 18 is continuously changed by the continuous circulation of liquid through the bead even when the applicator is not actually in use to apply liquid to a surface. Continuously fed by incoming liquid, the bead 18 swells outwardly beyond the supporting surface 42 and overflows the surface periphery 46 to descend along the underlying surface 48 of the applicator, which recedes inwardly of ther overflow periphery 46, FIG. 2. In this instance, the surface 48, itself, has the shape of a downwardly converging truncated cone, the juncture of the surfaces 42 and 48 forming the circular overflow periphery 46.

The liquid overflowing from the bead 18 is captured are retrieved by suction applied through the previously mentioned aspirating apertures 24 formed in the applicator 20 just below the overflow periphery 46 of the bead supporting surface 42. In the preferred construction illustrated, the apertures 24 are arrayed in an annular series and are formed by radial kerfs or slots, (also denoted by the number 24), FIGS. 2 and 3 cut into the margin of the applicator foot 24 underlying the bead supporting surface 42.

The aspirating apertures 24 open inwardly into the inside of the applicator 20, which is hollow. A cap 52 fitted into the lower end of the applicator 20 and forming the bottom of the foot 44, as shown in FIG. 2, closes the bottom of the applicator so that a vacuum applied to the inside of the applicator produces a liquid aspirating suction through the several apertures 24 which collectively constitute an aspirating intake. The aspirating action through the apertures 24 picks up and carries upwardly through the center of the applicator excess liquid overflowing from the bead 18. An aspirating orifice 53 opening downwardly through the center of the cap 52 continuously picks up any liquid that may reach the underside of the foot 44 so that it does not drip from the applicator 44.

As illustrated in FIG. 1, suction is applied to the hollow interior of the applicator 20 by means of a flexible vacuum line 54 connected to the upper end of the applicator and communicating through a regulator valve 56 with the lower region of the previously mentioned liquid supply reservoir 26. A vacuum pump 58 is connected to the upper portion of the reservoir 26 above the level of liquid 16 in the reservoir so that the pressure within the reservoir 26 is continuously maintained well below atmospheric. Air entering the lower portion of the reservoir 26 loses its entrained liquid particles to the surrounding body of liquid and bubbles up through the liquid to the top where it is evacuated by the vacuum pump.

It will be appreciated that the applicator 26 can be allowed to dwell for an indefinite period with liquid circulating through the bead 18 with no stagnation of liquid on the applicator and with no dripping of liquid from the applicator. All the liquid overflowing from the bead 18 is caught up in the aspirating air streams entering the underlying apertures 24 and 53 and is carried back into the liquid reservoir 26 for recycling to the applicator. There is no opportunity for the continuously flowing liquid to stagnate, dry out, harden, or otherwise deteriorate during its brief course along the applicator.

To apply liquid to the surface 10 of a solid object 14, the applicator 20 is traversed in relation to the surface with the overflow periphery 46 of the bead support surface 42 held away from the surface so as not to contact the surface while at the same time being sufficiently near the surface to effect contact of the convex meniscus 22 of the liquid bead 18 with the surface so that liquid is wiped from the bead 18 onto the surface. As will appear, there is no necessity to provide or maintain a precise dimensional spacing of the overflow periphery 46 from the surface to which liquid is applied in order to obtain a precise control of the quantity of liquid deposited on the surface. Neither is there any necessity to measure out the quantity of liquid supplied to the bead 18 or applied by the applicator.

With reference to the illustrations in the drawings, the applicator 20 is moved lengthwise by means of a fluid-powered actuating cylinder 60 to cause the activator foot 44 to traverse the surface 10 to which liquid is to be applied.

As previously intimated, the invention is intrinsically well suited to apply liquid to a surface to which access is limited, such as the inner surface 10 of the bore 12. The foot 44 of the applicator 20 has a circular form as viewed from below, FIG. 3, and is dimensionally diametrically to move freely down into the bore 12, as illustrated in FIGS. 1 and 4. The diametrical dimension of the circular overflow periphery 46 of the bead support surface 42 is such that there is a substantial but not necessarily precise spacing 61 of the overflow periphery 46 from the encircling bore surface 10 to which liquid is to be applied. The positional relationship of the applicator 20 to the bore 12, however, is such that the liquid bead 18 clinging to the liquid supporting surface 42 of the applicator and protruding beyond the overflow periphery 46 is disposed in interferring contact with the bore surface 10. Yet, for reasons which will appear, it is not necessary that the spacing 61 between the surface 10 and the overflow periphery 46 on the applicator be determined or maintained with precision.

The application of liquid to a surface requires only a single pass of the applicator 20. However, to apply liquid to the bore surface 10, the applicator 20 is inserted the requisite distance down into the bore 12 and then withdrawn along the bore surface 10 to which liquid is to be applied.

As the applicator 20 is retracted, as indicated by the arrow 62 in FIG. 4, liquid 16 from bead 18 is wiped onto the surface 10 being traversed. This wiping action which deposits liquid on the surface 10 is followed immediately by the aspiration of liquid from a zone 66, FIG. 4, immediately below the area of contact of the liquid bead 18 with the surface 10.

The liquid wiped onto the surface 10 by the moving bead 18 tends to penetrate the surface, if it is porous, and tends to adhere to the surface. As the application of liquid by the moving applicator 20 continues, the liquid deposited on the surface 10 is partially sucked up and removed by the aspiring action of air entering the aspirating orifices 24.

The degree to which the liquid 16 applied to the surface 12 remains deposited on the surface 12 is determined by the conjoint interaction of the tenaciousness by which the liquid adheres to the surface 12 and the strength of the aspirating action on the deposited liquid of the air entering the aspirating orifices 46, which are disposed in close proximate relation to the liquid being wiped onto the surface.

The tenacity by which the deposited liquid 16 adheres to the surface 10 is determined by the character of the surface and the character of the liquid. The strength of the aspirating action, which for any given surface and for any given liquid determines the quantity of liquid left deposited on the surface after the aspirating action has passed, is adjustable by regulating the degree of suction applied to the applicator 20. For purposes of illustration, the applied suction and hence the intensity of the aspirating action are regulated by adjusting the regulator valve 56, installed as shown between the applicator 20 and the vacuum pump 58. The aspirating action which accompanies the wiping of liquid from the bead 18 onto the surface 12 leaves on the surface 12 a uniform deposit of liquid 16 which can be accurately regulated to conform to any desired quantity of deposit within a wide range of operational capability, simply by adjusting the degree of vacuum or suction applied through the aspirating orifices 24. If desired, the aspirating action can be increased to substantially clean the surface of deposited liquid, reducing virtually to any degree desired the liquid left deposited on the surface.

The refined control of the liquid left deposited on the surface 10, through the agency of the controlled suction obviates any need, as previously indicated, for precisely controlling the spacing of the overflow periphery 46 from the surface 10 being traversed. At the same time, the constant aspiration of liquid through the orifices 24 effectively prevents dripping or wastage of liquid from the applicator during a liquid applying operation and also during standby conditions when the applicator is held in readiness for instant use with liquid circulating through the bead 18.

Moreover, the apparatus functions to avoid leaving any deposit of excess liquid at any boundary of the surface area to which liquid is applied. Hence, there is no excess liquid left at the juncture of the bore 10 with the external surface 68 of the object 14, FIG. 5.

As illustrated in FIG. 6, the apparatus is well adapted to apply liquid to the interior surface **10*a* of a bore 12*a* formed in an object 14*a* which, itself, is a composite of a plurality of stacked laminae or plates 70 which together define the bore 12*a*. The liquid applied to the surface 10*a* may penetrate and spread out into the interfaces, between the adjacent laminae 70 as indicated by the lines 72 in FIG. 6**.

If desired, the vacuum applied to the inside of the applicator 20 and the intensity of the consequent aspiration through the orifices 24 can be increased to scrub the interior of the bore 12*a* as the applicator moves along and leave the interior bore surface 10*a* virtually cleaned of liquid.

The liquid moving out by capillary action into the interfaces between the laminae 70 can form bonds, also denoted by the number 72, between the laminae.

The apparatus is extremely advantageous in applying an anerobic adhesive to the interfaces between laminae defining the bore 12*a* while leaving the bore surface 10*a* substantially free of the adhesive material. An anerobic material which can be applied to advantage in this manner is available from the Loctite Corp. of Newington, Conn., under the commercial designations of "R.C. 75," "R.C. 40" or "R.C. 35."

The invention is claimed as follows:

1. For applying liquid to the interior surface of a bore within an object, an elongated applicator of generally cylindrical form defining a generally circular shoulder having an overflow periphery dimensioned diametrically to fit within the bore leaving a small but noncritical radial space between the overflow periphery and the bore, liquid supply means for supplying the liquid continuously to the applicator to flow onto the shoulder thereof and cling thereto to define a liquid bead which under the restraint of surface tension protrudes beyond the overflow periphery sufficiently to contact the bore surface when the applicator is positioned within the bore, said applicator defining an aspirating intake underlying the overflow periphery in circumferentially distributed relation to said shoulder, and suction means connected with said aspirating intake on the applicator to continuously apply suction thereto to aspirate liquid from an annular zone immediately below the overflow periphery to prevent dripping and wastage of liquid from the applicator even when the applicator is removed from a bore and to remove a portion of the liquid deposited on a surrounding bore surface by the liquid bead on the shoulder as an incident to passage of the applicator through the bore.

2. For applying a liquid to the surface of an object, an elongated applicator of a generally cylindrical form disposed in an upright position and defining thereon a liquid bead supporting shoulder having the shape of a downwardly flared truncated cone, a liquid supply element disposed around an upper portion of the applicator and defining an annular liquid supply outlet encircling the applicator, liquid supply means connected with said supply element to feed liquid continuously thereto to emerge from said supply outlet in encircling relation to the applicator and descend continuously along the external surface of the applicator to said bead supporting shoulder to which the liquid adheres and swells outwardly under the restraint of surface tension to form a bead defining a convex annular meniscus protruding beyond said bead supporting shoulder, said applicator defining an annular series of aspirating orifices immediately underlying said shoulder, suction means connected with said aspirating orifices for continuously applying suction thereto and aspirating through said orifices liquid overflowing from said bead supporting shoulder so that there is a continuous circulation of liquid through the bead with no stagnation of liquid on the applicator: and means connected with said applicator to move the latter along the surface of an object with the periphery of the bead supporting shoulder disposed in proximate, spaced relation to the surface to contact the surface with the liquid meniscus protruding from the bead supporting shoulder to apply liquid to the surface.

3. A device for applying a liquid to a generally vertical receiving surface of an object, comprising an applicator having a substantially vertical exposed applicator surface, means for supplying a layer of a liquid to an upper portion of said applicator surface to cause the liquid to descend by gravity along said applicator surface, an outwardly projecting exposed protrusion on a lower portion of said applicator surface and extending generally horizontally therealong, said protrusion being substantially parallel with and in spaced proximity to said receiving surface, said protrusion causing said descending liquid to swell outwardly over and around said protrusion to form an outwardly protruding liquid bead having a convex meniscus, said applicator having aspirating intake means on said applicator and underlying said protrusion, suction means for producing a partial vacuum in said aspirating intake means for aspirating air and liquid into said aspirating intake means from a lower portion of said liquid bead to prevent any dripping of said liquid while maintaining continuous circulation of said liquid through said liquid bead and around said protrusion, and means for causing relative traversing movement between said applicator and said receiving surface of the object with said protrusion in spaced proximity to said receiving surface and with said convex meniscus of said liquid bead in contact with said receiving surface to apply the liquid to said receiving surface.

4. A device for applying a liquid to a descending receiving surface of an object, comprising an applicator having a descending applicator surface, means for applying a layer of a liquid to an upper portion of said applicator surface to cause the liquid to descend by gravity along said applicator surface, an outwardly projecting exposed protrusion on a lower portion of said applicator surface and extending generally horizontally therealong, said protrusion being substantially parallel with and in spaced proximity to said receiving surface, said protrusion causing said descending liquid to swell outwardly over and around said protrusion to form an outwardly protruding liquid bead having a convex meniscus, said applicator having aspirating intake means on said applicator and underlying said protrusion, suction means for producing a partial vacuum in said aspirating intake means for aspirating air and liquid into said aspirating intake means from a lower portion of said liquid bead to prevent any dripping of said liquid while maintaining continuous circulation of said liquid through said liquid bead and around said protrusion, and means for causing relative traversing movement between said applicator and said receiving surface of the object with said protrusion in spaced proximity to said receiving surface and with said convex meniscus of said liquid bead in contact with said receiving surface to apply the liquid to said receiving surface.

5. A device for applying a liquid to a generally cylindrical generally vertical interior receiving surface within an object, comprising an applicator having a generally vertical generally cylindrical applicator surface, means for supplying a layer of a liquid to an upper portion of said applicator surface to cause the liquid to descend by gravity along said applicator surface, an outwardly projecting annular shoulder on a lower portion of said generally cylindrical applicator surface, said shoulder having an annular overflow periphery dimensioned to fit within said interior receiving surface with a small but noncritical annular space between said overflow periphery and said interior receiving surface, said annular shoulder causing the descending liquid to swell outwardly over and around said shoulder to form an annular outwardly protruding liquid bead having a convex meniscus, said applicator having aspirating intake means underlying said annular shoulder and distributed around said applicator with an annular distribution, suction means for producing a partial vacuum in said aspirating intake means for aspirating air and liquid into said aspirating intake means from a lower portion of said annular liquid bead to prevent any dripping of said liquid while maintaining continuous circulation of said liquid through said liquid bead and around said shoulder, and means for causing relative traversing movement between said applicator and said interior receiving surface of the object with said shoulder in spaced proximity to said interior receiving surface and with said convex meniscus of said annular liquid bead in contact with said interior receiving surface to apply the liquid to said receiving surface.

* * * * *

UNITED STATES PATENT OFFICE

CERTIFICATE OF CORRECTION

Patent No. 4,092,951 Dated June 6, 1978

Inventor(s) Floyd B. Kopis

It is certified that error appears in the above-identified patent and that said Letters Patent are hereby corrected as shown below:

Column 3, line 13, "clean" should be --clear--

Column 4, line 38, "ther" should be --the--

Column 4, line 43, "are" should be --and--

Column 6, line 16, "aspiring" should be --aspirating--

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*